US006076510A

United States Patent [19]

Kim

[11] Patent Number: 6,076,510

[45] Date of Patent: Jun. 20, 2000

[54] METHOD AND APPARATUS FOR CORRECTING AIR-FLOW SENSOR OUTPUT AND ADAPTING DATA MAP USED TO CONTROL ENGINE OPERATING PARAMETERS

[75] Inventor: Sounghoon Kim, Seoul, Rep. of Korea

[73] Assignee: Hyundai Motor Co., Seoul, Rep. of Korea

[21] Appl. No.: 09/083,503

[22] Filed: May 22, 1998

[51] Int. Cl.[7] ..... F02D 41/00

[52] U.S. Cl. ..... 123/681; 123/480; 123/674; 123/492; 123/493

[58] Field of Search ..... 123/681, 684, 123/674, 683, 687, 480, 492, 493

[56] References Cited

U.S. PATENT DOCUMENTS

| | | | |
|---|---|---|---|
| 4,831,987 | 5/1989 | Nakaniwa et al. | 123/492 |
| 4,928,654 | 5/1990 | Hosaka | 123/492 |
| 4,951,209 | 8/1990 | Nagaishi et al. | 123/492 |
| 4,951,635 | 8/1990 | Nakaniwa et al. | 128/492 |
| 4,957,088 | 9/1990 | Hosaka | 123/480 |
| 4,962,741 | 10/1990 | Cook et al. | 123/673 |
| 5,357,937 | 10/1994 | Bauer et al. | 123/683 |

FOREIGN PATENT DOCUMENTS 6-56114 7/1994 Japan .

*Primary Examiner*—Willis R. Wolfe
*Assistant Examiner*—Hieu T. Vo

[57] ABSTRACT

The apparatus for correcting air-flow sensor output includes an air-flow sensor sensing an air-flow in an intake of an engine, and other sensors sensing operating conditions of the engine. An electronic control unit determines whether the engine is operating in one of a first and second state based on the sensed operating conditions, and reads a correction factor from a data map based on the sensed operating conditions when the engine is operating in the first state. Also, the electronic control unit calculates a new correction factor based on the sensed operating conditions and stores the new correction factor in the data map when the engine is operating in the second state. Then, the electronic control unit determines a corrected air-flow quantity based on the sensed air-flow and one of the read correction factor and the calculated correction factor.

20 Claims, 6 Drawing Sheets

METHOD AND APPARATUS FOR CORRECTING AIR-FLOW SENSOR OUTPUT AND ADAPTING DATA MAP USED TO CONTROL ENGINE OPERATING PARAMETERS

BACKGROUND OF THE INVENTION

1. Field of the Invention

The present invention relates to a method and apparatus for correcting air-flow sensor output and adapting a data map used to control engine operating parameters; and more particularly, to a method and apparatus for correcting air-flow quantities output by an air-flow sensor and to a method and apparatus for adapting a data map storing correction values used to correct detected air-flow quantities.

2. Description of Related Art

The majority of vehicles produced are controlled using an electronic control unit (ECU). The ECU controls such engine functions as fuel injection quantity and ignition timing. Typically, the ECU receives a plurality of sensor inputs to determine the engine operating conditions, and based thereon controls respective components of the engine to produce a desired fuel injection quantity, ignition timing, etc.

Systems which control the air/fuel ratio (A/F ratio) do so based upon the output of an air-flow sensor, typically a hot film air-flow meter, and an oxygen sensor positioned in an exhaust passage of the engine. U.S. Pat. No. 4,962,741 to Cook, hereby incorporated by reference, discloses such a device. As disclosed in Cook, a base fuel injection quantity is determined based on the air-flow quantity detected by the air-flow sensor. This base injection quantity is then regulated based on the oxygen sensor output to perform a fine fuel metering and obtain a stoichiometric A/F ratio. Specifically, a lambda regulation value is calculated based on the oxygen sensor output, and the base injection quantity is altered in accordance with the lambda regulation value. A/F ratios above the stoichiometric value result in rich combustion, and A/F ratios below the stoichiometric value result in lean combustion. For certain desired operating conditions, the engine is controlled to achieve lean or rich combustion. Unfortunately, if the air-flow quantity indicated by the air-flow sensor output differs from the actual air-flow quantity, then fuel injection, ignition timing, etc., may be improperly controlled. For instance, if ignition timing is improperly advanced, the engine may knock. In the Cook patent, the basic injection quantity is further refined to obtain fuel injection control signals corresponding to the fuel injector for each cylinder and to control the A/F ratio of each cylinder.

FIG. 1A illustrates the air-flow quantities output by an air-flow sensor with respect to engine RPM when the engine is operating under a high load. FIG. 1B illustrates the actual air-flow quantities under the same conditions. As a comparison of FIGS. 1A and 1B indicates, the output from the air-flow sensor at low RPM and high load engine conditions is distorted. Accordingly, under these engine conditions, fuel injection, ignition timing, etc. will not be properly controlled.

When the detected air-flow quantity reflects the real air-flow quantity, the lambda regulation value, approaches a value of 1 such that the base injection quantity is not altered. When, however, the detected air-flow quantity is less than or greater than the real air-flow quantity, the lambda regulation value becomes greater than or less than 1, respectively, to correct errors in the base injection quantity caused by the erroneously detected air-flow quantity. Unfortunately, during transient engine operating conditions, the lambda regulation value cannot be accurately determined.

As an alternative or additional correction technique, some ECU's store an air-flow correction map of fixed correction factors. During engine production, the differences between the detected and actual air-flow quantities are tested for a variety of engine conditions. Each engine condition is referenced by the engine RPM and the throttle opening degree. A proper correction factor is then coded into the air-flow correction map for each RPM and throttle opening degree pair.

During operation, the ECU addresses a correction factor from the air-flow correction map based on the engine RPM and throttle degree opening, and multiplies the detected air-flow value by the correction factor to produce a corrected air-flow quantity.

The air-flow correction map is produced using a test engine, and then this map is stored in the ECU's memory for the engines produced during mass production. Unfortunately, engine operating conditions vary from engine to engine and vehicle to vehicle. While the air-flow correction map helps produce reliable air-flow quantities for the test engine, this may no: be the case for the engines produced during mass production. Accordingly, to develop reliable air-flow correction maps for each engine would require performing a test routine for each engine. This technique, however, is not practical in mass production.

SUMMARY OF THE INVENTION

The object of the present invention is to provide a method and apparatus for correcting detected air-flow quantities used to control engine operating parameters such that the disadvantages discussed above with respect to the conventional art are overcome.

Another object of the present invention is to provide a method and apparatus for adjusting an air-flow correction map such that the values therein become adapted to the corresponding engine.

These and other related objects are achieved by providing apparatus for correcting air-flow sensor output, comprising: an air-flow sensor sensing an air-flow in an intake of an engine; engine condition sensing means for sensing operating conditions of said engine; control means for first determining whether said engine is operating in one of a first and second state based on said sensed operating conditions, for reading a correction factor from a data map based on said sensed operating conditions when said control means determines said engine is operating in said first state, for calculating a new correction factor based on said sensed operating conditions and storing said new correction factor in said data map when said control means determines said engine is operating in said second state, and second determining a corrected air-flow quantity based on said sensed air-flow and one of said read correction factor and said calculated correction factor.

These and other related objects are further achieved by providing a method for correcting air-flow sensor output, comprising: a) sensing an air-flow in an intake of an engine using and air-flow sensor; b) sensing operating conditions of said engine; c) determining whether said engine is operating in one of a first and second state based on said sensed operating conditions; d) reading a correction factor from a data map based on said sensed operating conditions when said step c) determines said engine is operating in said first state; e) calculating a new correction factor based on said sensed operating conditions when said step c) determines said engine is operating in said second state; f) storing said new correction factor in said data map when said step c) determines said engine is operating in said second state; and g) determining a corrected air-flow quantity based on said sensed air-flow and one of said read correction factor and said calculated correction factor.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
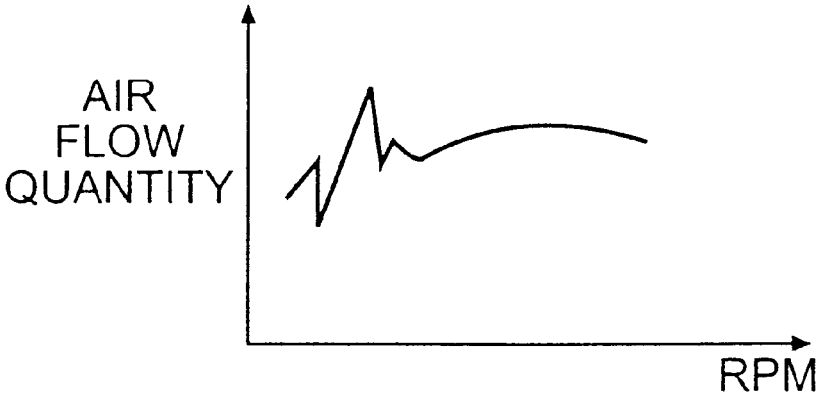
FIG. 1A CONVENTIONAL ART
FIG. 1A and 1B illustrate detected and actual air-flow quantities versus engine RPM.
Figure 1B:
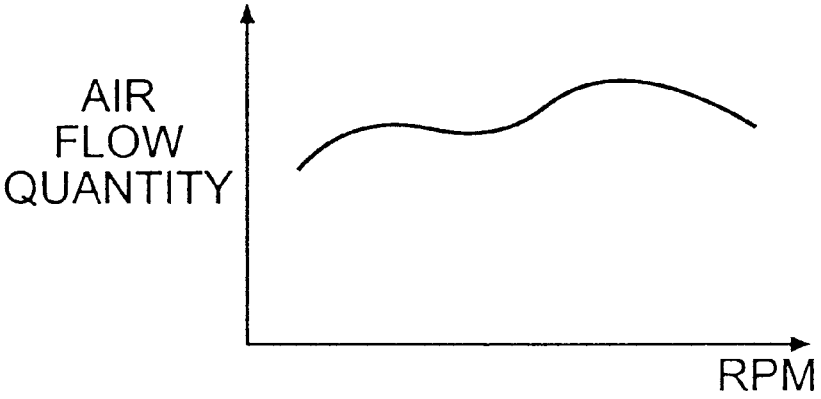
FIG. 1B CONVENTIONAL ART
Figure 2:
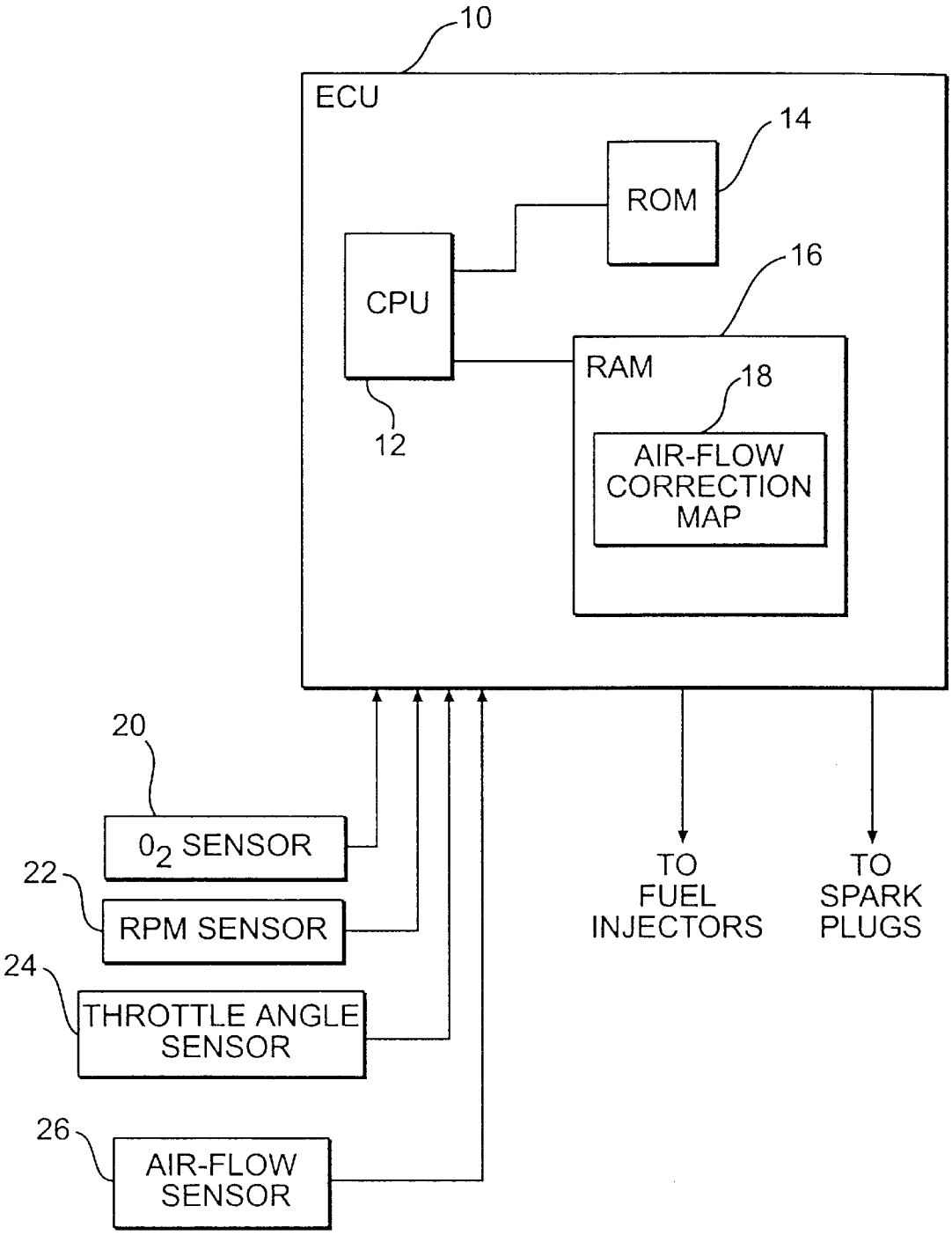
FIG. 2 illustrates the ECU according to the present invention.

FIG. 2 illustrates one embodiment of the ECU 10 according to the present invention. As shown in FIG. 2, the ECU includes a central processing unit (CPU) 12 connected to a read only memory (ROM) 14 and a random access memory (RAM) 16. As illustrated in FIG. 2, the RAM 16 stores an air-flow correction map 18.

As further illustrated in FIG. 2, the ECU 10 receives the output from an oxygen sensor 20, disposed in the exhaust passage of an engine being controlled by the ECU 10; an RPM sensor 22 which outputs the engine RPM; a throttle angle sensor 24 which outputs the throttle angle of the engine; and an air-flow sensor 26, preferably a hot film air-flow sensor, disposed in an air intake of the engine. Based on the output of the oxygen sensor 20, the RPM sensor 22, the throttle angle sensor 24, the air-flow sensor 26, as well as, various other sensors known to those skilled in the art, the ECU 10 controls the operating condition of the engine. For instance, as illustrated in FIG. 2, the ECU outputs control signals to the fuel injectors to control the fuel injection quantity, and also outputs ignition timing control signals to the spark plugs to control ignition timing.

The ECU 10 of FIG. 2 controls the fuel injection and ignition timing in the same manner as discussed above in the Background of the Invention section. Specifically, the CPU 12 operates based on a program stored in ROM 14 to determine control quantities such as the fuel injection quantity and the spark plug ignition timing based on the outputs from the various sensors such as the oxygen sensor 20, the RPM sensor 22, the throttle angle sensor 24, and the air-flow sensor 26.

Specifically, the ECU 10 controls the fuel injection quantity, spark ignition timing, etc., based on (1) an air-flow quantity detected by the air-flow sensor 26 and corrected using a correction factor from an air-flow correction map 18, and (2) fine fuel metering control performed in accordance with the output of the oxygen sensor 20. The ECU 10, however, also adapts the air-flow correction map 18 to the engine being controlled by the ECU 10. In this manner, the ECU 10 overcomes the various disadvantages discussed above with respect to conventional ECU's, and reduces the reliance on lambda regulation.

FIG. 3 illustrates the process by which the ECU 10 corrects air-flow quantities output by the air-flow sensor 26 using the air-flow correction map 18.

Figure 3A:
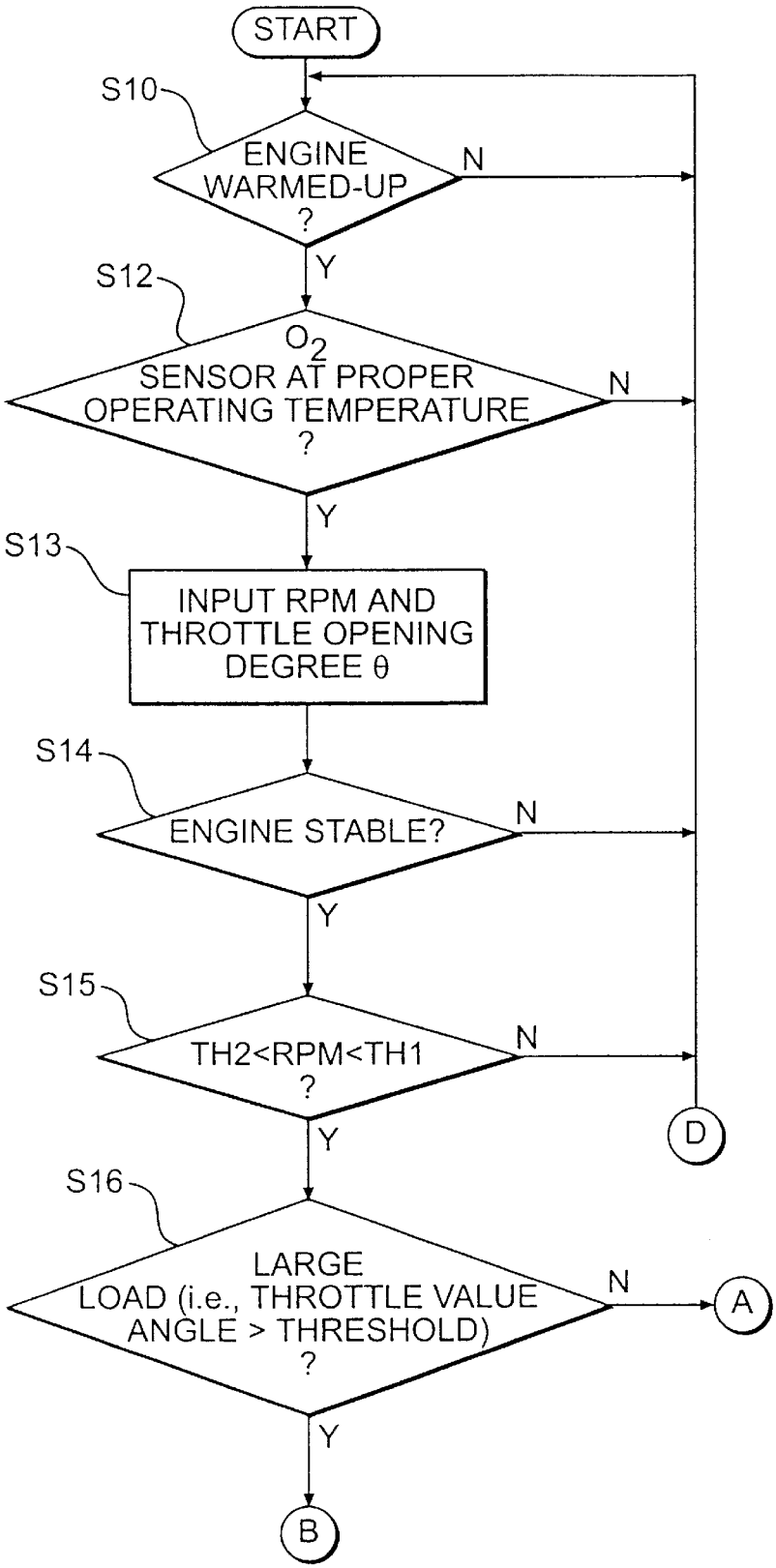
FIGS. 3A–3C illustrate the process performed by the ECU according to the present invention to correct detected air-flow quantities.
Figure 3B:
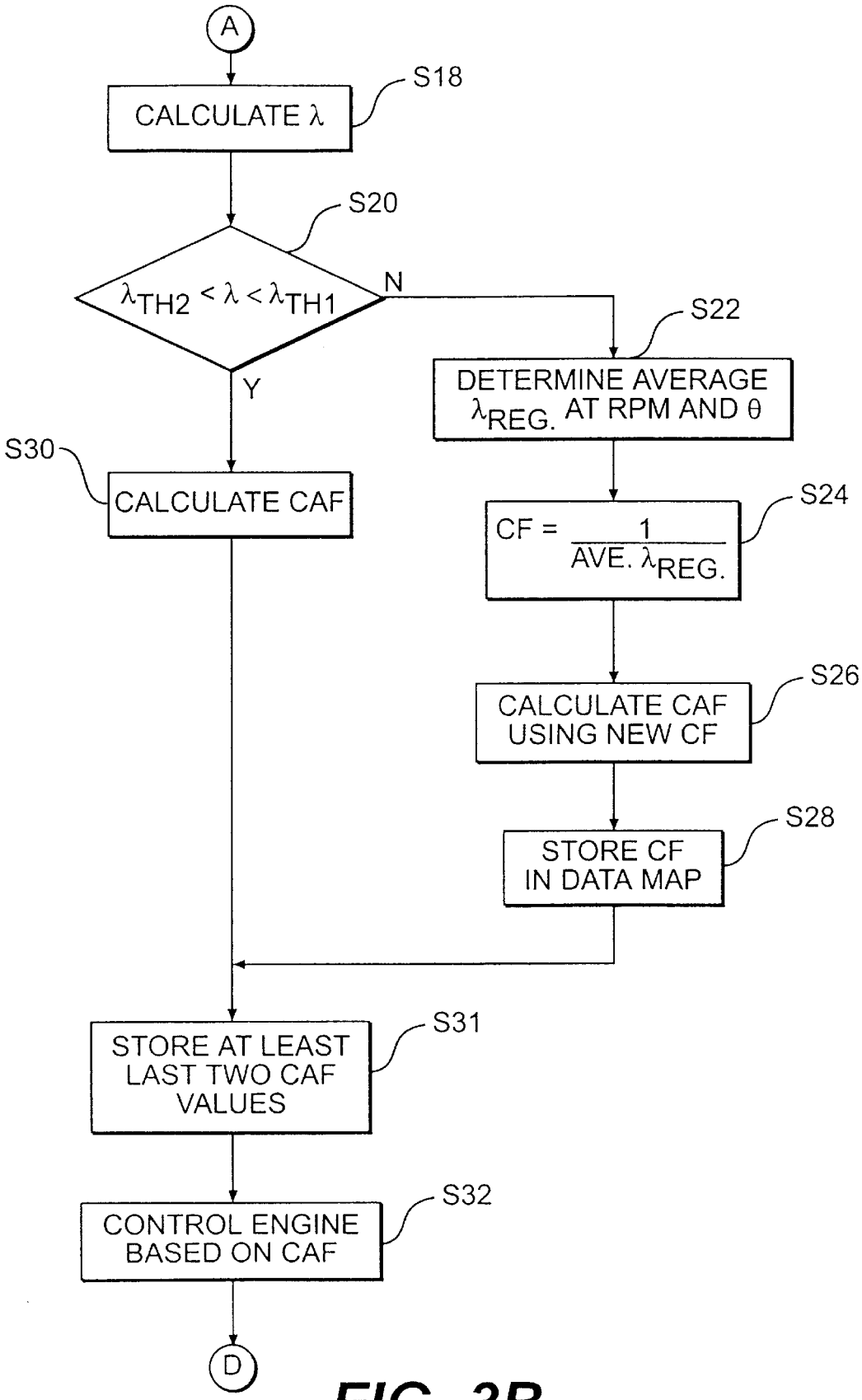

As shown in FIG. 3A, the ECU 10 first determines whether or not the engine is warmed-up. If not warmed-up, then processing awaits engine warm-up. If the engine is warmed-up, then in step S12 the ECU 10 determines whether or not the oxygen sensor 20 is at the proper operating temperature. As one skilled in the art knows, the oxygen sensor 20 must reach a certain temperature before operating properly. If the oxygen sensor 20 is not at the proper operating temperature, then processing waits until the oxygen sensor 20 reaches the proper operating temperature.

If the oxygen sensor 20 has reached the proper operating temperature, then processing proceeds to step S13. In step 513, the ECU 10 inputs the engine RPM and throttle degree opening θ from the RPM sensor 22 and the throttle angle sensor 24.

In step S14, the ECU 10 determines whether or not the engine is stable. In a preferred embodiment, the ECU 10 determines that the engine is operating in a stable condition when the engine RPM fluctuates within ±40 RPM of the RPM value input in step S13 and the throttle opening degree fluctuates ±2 degrees within the throttle opening degree input in step S13.

If the engine is not stable, then processing proceeds from step S14 to step S10. If the engine is stable, then processing proceeds to step S15.

In step S15, the ECU 10 determines whether the engine is operating within a predetermined RPM range of TH2 to TH1. If the RPM input in step S13 falls outside the range TH2 to TH1, processing proceeds from step S15 to step S10; otherwise, processing proceeds from step S15 to step S16.

In step S16, the ECU compares the throttle degree opening θ to a threshold value, and determines whether or not the throttle degree opening θ is greater than the threshold. If the throttle opening degree θ is less than or equal to the threshold, this indicates a relatively small load on the engine. Accordingly, processing proceeds to step S18 in FIG. 3B.

In step S18, the ECU 10 calculates the lambda regulation value λ by multiplying the output of the oxygen sensor 20 by a gain factor G and integrating the result. Since it was determined in step S16 that the engine is operating at a low load state, the output from the air-flow sensor 26 should closely approximate the actual air-flow quantity. Consequently, the engine should have been controlled to maintain a stoichiometric A/F ratio using previous corrected air-flow quantities. Therefore, the lambda regulation value calculated in step S18 should be close to the value indicating a stoichiometric A/F ratio.

Accordingly, in step S20 the ECU 10 determines whether or not the lambda regulation value λ calculated in step S18 is in a predetermined range of $\lambda_{TH2}$ to $\lambda_{TH1}$ about the stoichiometric value of 1. In a preferred embodiment the lambda regulation value range of $\lambda_{TH2}$ to $\lambda_{TH1}$ is from 0.9 to 1.1. Of course, depending upon the operating conditions desired, the range could be adjusted. If the ECU 10 determines in step S20 that the lambda regulation value $\lambda$ is within the predetermined range, then the ECU 10 determines that the engine is operating as expected, and processing proceeds to step S30.

In step S30, the ECU 10 calculates a corrected air-flow quantity CAF. To calculate the corrected air-flow quantity, the CPU 12 reads the correction factor CF corresponding to the input engine RPM and throttle degree opening $\theta$ from the air-flow correction map 18. The CPU 12 then multiplies the correction factor CF by the output from the air-flow sensor 26 to calculate the corrected air-flow quantity CAF. Processing then proceeds to step S31.

If, however, the lambda regulation value $\lambda$ in step S20 is not within the predetermined range, then processing proceeds from step S20 to step S22. In step S22 the ECU 10 repeatedly calculates the lambda regulation value for a predetermined period of time, and determines an average lambda regulation value therefrom. Then, in step S24, the ECU 10 calculates a correction factor CF which is the inverse of the average lambda regulation value determined in step S22. Based on the correction factor calculated in step S24, the ECU 10 then calculates a corrected air-flow quantity in step S26.

Next, in step S28, the new correction factor CF calculated in step S24 is stored in the air-flow correction map 18 for the RPM and throttle opening $\theta$ input in step S14. In this manner, the correction factors for low load conditions are adapted to the engine being controlled by the ECU 10. Processing then proceeds to step S31.

In step S31, the corrected air-flow quantity is stored. In a preferred embodiment, only the last two corrected air-flow quantities are stored, as opposed to storing all corrected air-flow quantities. The throttle angle values corresponding to the corrected air-flow quantities being stored are also stored.

In step S32, the ECU 10 controls the engine based on the corrected air-flow quantity. For instance, the ECU 10 calculates fuel injection quantities, ignition timings, etc., using techniques well known to those skilled in the art wherein the corrected air-flow quantity CAF is used as the air-flow quantity in those techniques. Processing then proceeds to step S10.

Figure 3C:
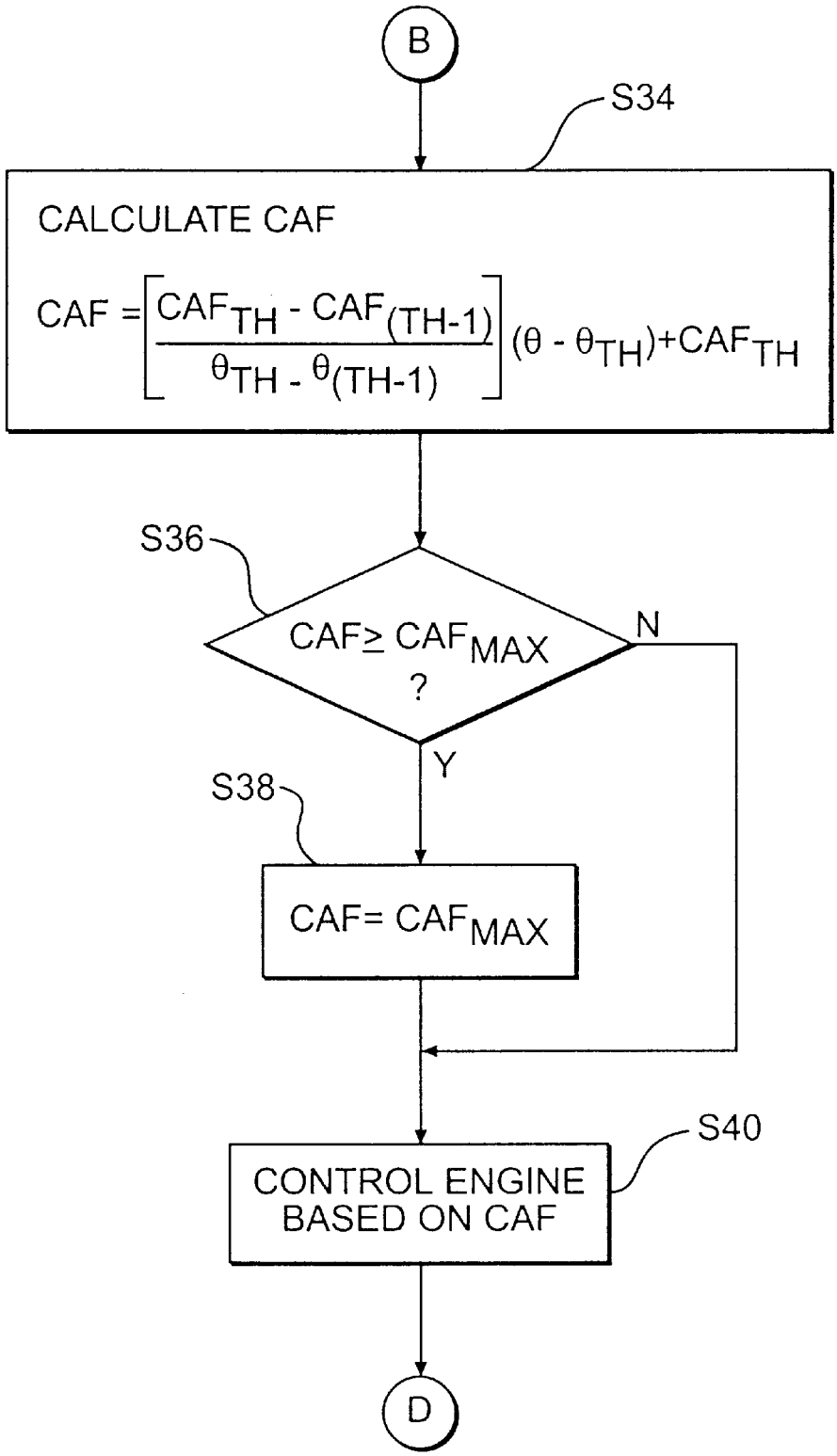
Figure 4:
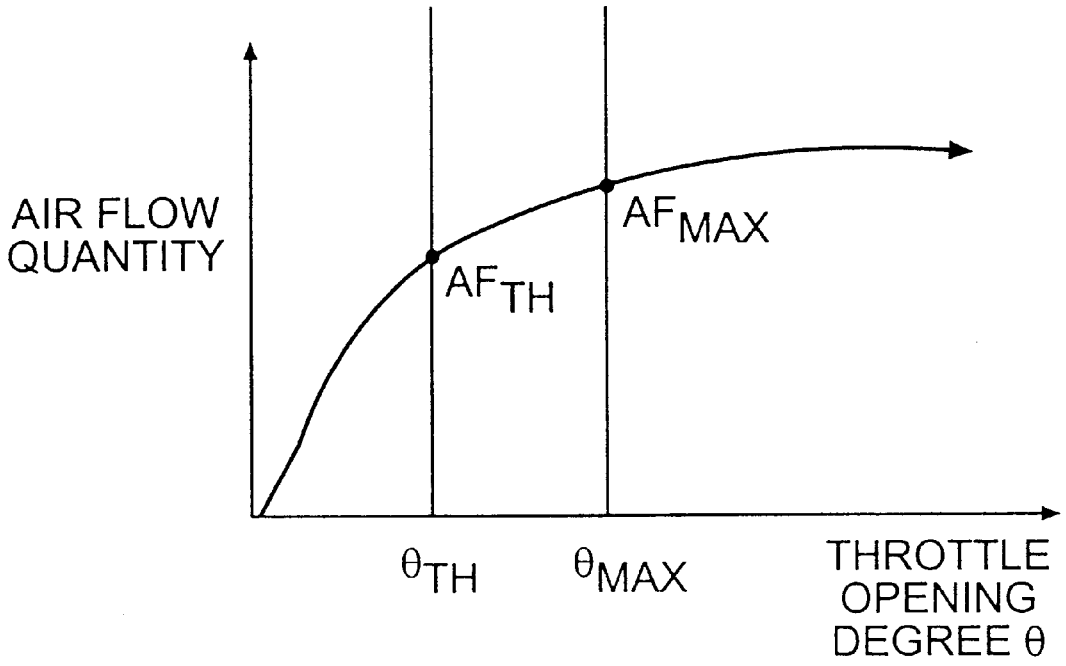
FIG. 4 illustrates the relationship between air-flow quantity and throttle opening degree according to the present invention.

If, in step S16, the ECU 10 determined that the engine was experiencing a large load, then processing proceeds to the steps shown in FIG. 3C. FIG. 3C shows an embodiment of the present invention for determining a corrected air-flow quantity when the engine is operating under a heavy load.

As shown in FIG. 3C, processing proceeds to step S34 where the corrected air-flow quantity is calculated according to the following equation:

$$CAF = \left(\frac{CAF_{TH} - CAF_{(TH-1)}}{\theta_{TH} - \theta_{(TH-1)}}\right)(\theta - \theta_{TH}) + CAF_{TH} \quad (1)$$

where $\theta$ is the current throttle angle detected in step S13; $CAF_{TH}$ is the corrected air-flow quantity for the threshold throttle angle $\theta_{TH}$; $\theta_{(TH-1)}$ is the throttle angle value input in step S13 prior to the threshold throttle angle $\theta_{TH}$; and $CAF_{(TH-1)}$ is the corrected air-flow quantity determined for throttle angle $\theta_{(TH-1)}$, these values having been stored in step S31.

Next, in step S36, the corrected air-flow quantity calculated in step S34 is compared to a predetermined maximum corrected air-flow quantity $CAF_{MAX}$. If the corrected air-flow quantity calculated in step S34 is greater than or equal to the predetermined maximum corrected air-flow quantity $CAF_{MAX}$, processing proceeds to step S38; otherwise, processing proceeds to step S40. In step S38, the corrected air-flow quantity is set equal to the predetermined maximum air-flow quantity. Processing then proceeds to step S40, where the ECU 10 controls the engine based on the corrected air-flow quantity in the same manner as discussed above with respect to step S32. Processing then returns to step S10.

As the discussion above reveals, the correction factors corresponding to low load engine conditions are adjusted so that the air-flow correction map storing these values adapts to the engine being controlled by the ECU 10. As a result, the ECU 10 is also able to generate corrected air-flow quantities at heavy load conditions which are adjusted for the engine being controlled by the ECU 10. Consequently, proper engine control is achieved so that adverse engine operating conditions, such as engine knock, are avoided. Proper engine control is also achieved during transient engine operating conditions.

While the invention has been described in connection with what is presently considered the most practical and preferred embodiments, it is to be understood that the invention is not limited to the disclosed embodiments, but on the contrary, is intended to cover various modifications and equivalent arrangements included within the spirit and scope of the appended claims.

What is claimed is:

1. Apparatus for correcting air-flow sensor output, comprising:

an air-flow sensor sensing an air-flow in an intake of an engine;

engine condition sensing means for sensing operating conditions of said engine;

control means for first determining whether said engine is operating in one of a first and second state based on said sensed operating conditions, for reading a correction factor from a data map based on said sensed operating conditions when said control means determines said engine is operating in said first state, for calculating a new correction factor based on said sensed operating conditions and storing said new correction factor in said data map when said control means determines said engine is operating in said second state, and second determining a corrected air-flow quantity based on said sensed air-flow and one of said read correction factor and said calculated correction factor.

2. The apparatus of claim 1, wherein said control means third determines a lambda regulation value based on said sensed operation conditions, and first determines whether said engine is operating in one of said first and second state based on said lambda regulation value.

3. The apparatus of claim 2, wherein said control means compares said lambda regulation value to a lambda regulation range representing a substantially stoichiometric air-to-fuel ratio, determines that said engine is operating in said first state when said lambda regulation value falls within said lambda regulation range, and determines that said engine is operating in said second state when said lambda regulation value falls outside said lambda regulation range.

4. The apparatus of claim 3, wherein said control means calculates said new correction factor by determining a plurality of lambda regulation values at said sensed operation conditions, calculating an average lambda regulation value based on said plurality of lambda regulation values, and determining said new correction factor as an inverse of said average lambda regulation value.

5. The apparatus of claim 1, wherein said control means calculates said new correction factor by determining a plurality of lambda regulation values at said sensed operation conditions, calculating an average lambda regulation value based on said plurality of lambda regulation values, and determining said new correction factor as an inverse of said average lambda regulation value.

6. The apparatus of claim 1, wherein said control means determines whether an air-to-fuel ratio of said engine is substantially a stoichiometric air-to-fuel ratio based on said sensed operating conditions, determines that said engine is operating in said first state when said air-to-fuel ratio of said engine is determined to be a substantially stoichiometric air-to-fuel ratio, and determines that said engine is operating in said second state when said air-to-fuel ratio of said engine is determined not to be a substantially stoichiometric air-to-fuel ratio.

7. The apparatus of claim 1, wherein said control means determines whether said engine is operating under a large load based on said operating conditions, and performs said first determining, said reading and storing, said calculating and said second determining if said control means determines that said engine is not operating under a large load.

8. The apparatus of claim 7, wherein said control means performs a linear estimation of said corrected air-flow quantity based on said operating conditions when said control means determines that said engine is operating under a large load.

9. The apparatus of claim 8, wherein said control means compares said linearly estimated corrected air-flow quantity to a predetermined maximum corrected air-flow quantity, and determines said predetermined maximum corrected air-flow quantity as said linearly estimated corrected air-flow quantity if said linearly estimated corrected air-flow quantity exceeds said predetermined maximum corrected air-flow quantity.

10. The apparatus of claim 1, wherein said engine condition sensing means senses at least a throttle opening degree and a speed of said engine.

11. A method for correcting air-flow sensor output, comprising:

a) sensing an air-flow in an intake of an engine using and air-flow sensor;

b) sensing operating conditions of said engine;

c) determining whether said engine is operating in one of a first and second state based on said sensed operating conditions;

d) reading a correction factor from a data map based on said sensed operating conditions when said step c) determines said engine is operating in said first state;

e) calculating a new correction factor based on said sensed operating conditions when said step c) determines said engine is operating in said second state;

f) storing said new correction factor in said data map when said step c) determines said engine is operating in said second state; and g) determining a corrected air-flow quantity based on said sensed air-flow and one of said read correction factor and said calculated correction factor.

12. The method of claim 11, further comprising:

h) determining a lambda regulation value based on said sensed operation conditions; and wherein said step c) determines whether said engine is operating in one of said first and second state based on said lambda regulation value.

13. The method of claim 12, wherein said step c) comprises:

c1) comparing said lambda regulation value to a lambda regulation range representing a substantially stoichiometric air-to-fuel ratio;

c2) determining that said engine is operating in said first state when said lambda regulation value falls within said lambda regulation range; and c3) determining that said engine is operating in said second state when said lambda regulation value falls outside said lambda regulation range.

14. The method of claim 13, wherein said step e) comprises:

e1) determining a plurality of lambda regulation values at said sensed operation conditions;

e2) calculating an average lambda regulation value based on said plurality of lambda regulation values; and e3) determining said new correction factor as an inverse of said average lambda regulation value.

15. The method of claim 11, wherein said step e) comprises:

e1) determining a plurality of lambda regulation values at said sensed operation conditions;

e2) calculating an average lambda regulation value based on said plurality of lambda regulation values; and e3) determining said new correction factor as an inverse of said average lambda regulation value.

16. The method of claim 11, wherein said step c) comprises:

c1) determining whether an air-to-fuel ratio of said engine is substantially a stoichiometric air-to-fuel ratio based on said sensed operating conditions;

c2) determining that said engine is operating in said first state when said step c1) determines that said air-to-fuel ratio of said engine is a substantially stoichiometric air-to-fuel ratio; and c3) determining that said engine is operating in said second state when said step c1) determines that said air-to-fuel ratio of said engine is a substantially stoichiometric air-to-fuel ratio.

17. The method of claim 11, further comprising:

h) determining whether said engine is operating under a large load based on said sensed operating conditions; and i) performing said steps c)–g) if said step h) determines that said engine is not operating under a large load.

18. The method of claim 17, further comprising:

j) linearly estimating said corrected air-flow quantity based on said sensed operating conditions when said step h) determines that said engine is operating under a large load.

19. The method of claim 18, further comprising:

k) comparing said linearly estimated corrected air-flow quantity to a predetermined maximum corrected air-flow quantity; and l) determining said predetermined maximum corrected air-flow quantity as said linearly estimated corrected air-flow quantity if said step k) indicates that said linearly estimated corrected air-flow quantity exceeds said predetermined maximum corrected air-flow quantity.

20. The method of claim 11, wherein said step b) senses at least a throttle opening degree and a speed of said engine.

* * * * *